United States Patent [19]

Pennington, III et al.

[11] 4,275,680

[45] Jun. 30, 1981

[54] ANCHORING SYSTEM

[75] Inventors: John W. Pennington, III, Spotsylvania; Kenneth G. Thorsted, Fredericksburg, both of Va.

[73] Assignee: The United States of America as represented by the Secretary of the Navy, Washington, D.C.

[21] Appl. No.: 71,468

[22] Filed: Aug. 31, 1979

[51] Int. Cl.[3] ..... B63B 21/28

[52] U.S. Cl. ..... 114/295; 89/1 G; 102/504

[58] Field of Search ..... 114/294, 295; 89/1 G; 102/89 R; 52/155, 165; 175/4, 4.57; 405/244, 224

[56] References Cited

U.S. PATENT DOCUMENTS

| | | | |
|---|---|---|---|
| 854,624 | 5/1907 | Banks | 102/82 |
| 3,577,949 | 5/1971 | Mueller et al. | 114/295 |
| 3,673,963 | 7/1972 | McGowan | 89/1 G |

*Primary Examiner*—Charles E. Frankfort

*Attorney, Agent, or Firm*—R. S. Sciascia; A. L. Branning

[57] ABSTRACT

An anchoring system comprising a pointed anchor body having either a wire wrapped therearound in one embodiment thereof or a coiled wire disposed within a hollow portion of the anchor body in a second embodiment thereof. One end of the wire is fixed to the pointed end of the anchor body and the other end projects through a pusher plate at the other end of the anchor body, behind which is an explosive or propellant charge for actuating the anchor. When the charge is ignited the anchor body is driven out of the charge housing, which is configured to retain the pusher plate, causing the wire to unwind as the anchor body embeds itself.

3 Claims, 3 Drawing Figures

ANCHORING SYSTEM

BACKGROUND OF THE INVENTION

1. Field of the Invention

This invention relates generally to anchoring devices and more particularly to remotely operable anchoring systems which may be employed in any environment.

2. Description of the Prior Art

In the past, numerous designs for explosively propelled embedment anchors have been conceived. Examples of these prior art devices may be found in U.S. Pat. Nos. 2,993,461; 3,036,542, and 3,577,949. The devices disclosed in the first two of the aforementioned patents are actuated by firing pins which theoretically function when the anchoring system contacts the sea bottom. Systems of this type require the provision of safing devices to permit safe handling and stowage and thus tend to become complex and expensive systems. The system disclosed in the last mentioned patent requires manual manipulation, as by an underwater swimmer, in order to actuate the system. Obviously it would be highly desirable if a simple anchoring system could be provided which could, if necessary, be remotely actuated by a simple electrical signal.

SUMMARY OF THE INVENTION

The present invention obviates the aforementioned difficulties by providing a simple and inexpensive anchoring system which may be employed in any environment and which may readily be remotely actuated, if desired. The invention comprises a charge housing having a pointed anchor body disposed therein. In a first embodiment, a wire is tightly coiled around the anchor body with one end fixed to the pointed end of the anchor body and the other end fixed to a pusher plate abutting the inner end of the anchor body. In a second embodiment the anchor wire is coiled within a hollow rearward portion of the anchor body. Again, one end of the wire is fixed to the pointed end of the anchor body and the other end fixed to the pusher plate. An explosive or propellant charge is disposed within the charge housing behind the pusher plate, and when ignited, drives the anchor body out of the housing. The housing is configured to retain the pusher plate and thus the wire unwinds from around or within the anchor body as the anchor body embeds itself.

STATEMENT OF THE OBJECTS OF THE INVENTION

It is a primary object of this invention to provide a new and improved anchoring system.

It is another object of this invention to provide an anchoring system which is simple to construct and which may readily comply with size constraints.

It is a further object of this invention to provide an anchoring system which may be remotely operated in any environment.

BRIEF DESCRIPTION OF THE DRAWINGS

Other objects, advantages and novel features of the invention will become readily apparent upon consideration of the following detailed description of the invention when read in conjunction with the accompanying drawings wherein.

DESCRIPTION OF THE PREFERRED EMBODIMENTS

Figure 1:
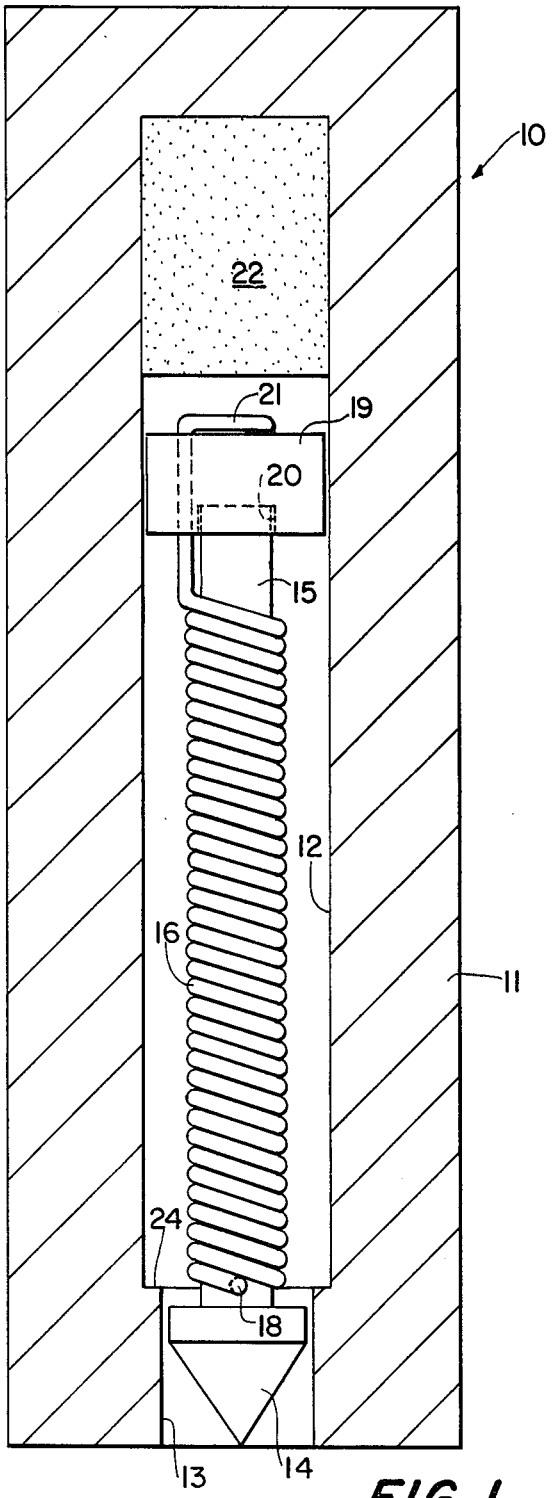
FIG. 1 is a sectional view of a first embodiment of the anchoring system of the present invention and illustrates the principal features thereof.

Attention now is directed to the drawings, wherein like numerals of reference designate like parts throughout the several views, and more particularly to FIG. 1 wherein there is illustrated the anchoring system of the present invention, designated generally by the reference numeral 10. The system 10 comprises a charge housing 11 having formed therein a central bore 12 and an anchor body socket 13 interconnecting the bore 12 and the exterior of the housing 11. A pointed anchor body 14 is disposed within the socket 13. The anchor body 14 has a body shaft 15 formed integral therewith and projecting into the bore 12. An anchoring wire 16 is tightly coiled around the shaft 15 and has one end 18 thereof fixed to the shaft 15 adjacent to the anchor body 14. The end 18 of the anchor wire 16 may typically be bent and positioned in a transverse aperture (not shown) in the shaft 15.

A pusher plate 19 having a blind socket 20 formed therein is disposed within the bore 12 with the rearward end of the shaft 15 projecting into the socket 20. The other end of the anchor wire 16, designated 21, passes through a hole in the pusher plate 19 and is then bent over against the rearward surface of the pusher plate 19. The end 21 may be welded or otherwise fixed to the pusher plate 19. An explosive or propellant charge 22 is disposed within the bore 12 behind the pusher plate 19. The charge 22 may be electrically initiated by any of various devices well known to those skilled in the art. For this reason no specific initiating device is shown since details of the initiating device form no part of the present invention.

Figure 3:
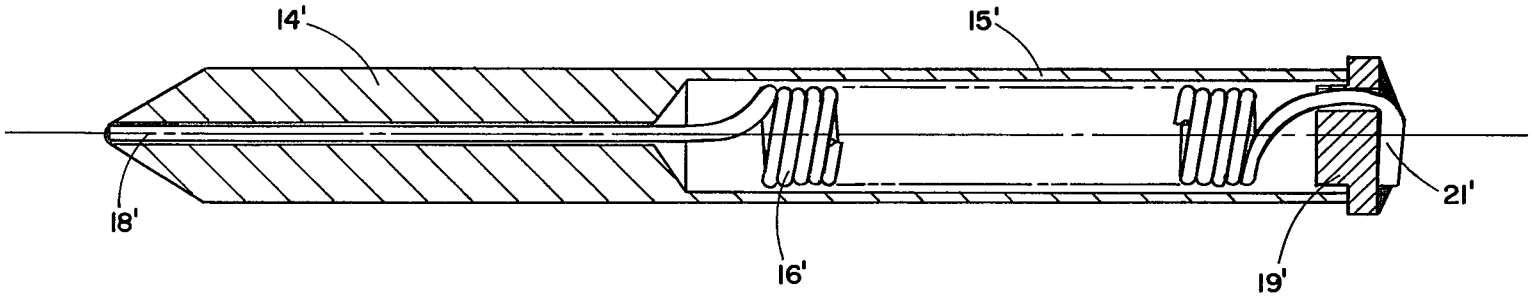
FIG. 3 is a sectional view of a second embodiment of the anchor body of the present invention and illustrates the principal features thereof.

Referring now to FIG. 3, there can be seen a second embodiment of the anchor body of the present invention. The charge housing would be identical with that shown in FIG. 1 and is consequently omitted from this view. The anchor of the second embodiment comprises a pointed anchor body 14' having a hollow body shaft 15' formed integral therewith. A tightly coiled anchoring wire 16' is disposed within the hollow shaft 15' and has one end 18' thereof positioned within a central aperture in the anchor body 14'. The wire 18' is soldered, welded, or otherwise secured to the tip of the anchor body 14'. A flanged pusher plate 19' abuts the rearward end of the hollow shaft 15' with a portion of the pusher plate projecting into the hollow shaft. The other end 21' of the anchoring wire 16' projects through an aperture in the pusher plate 19' and is soldered, welded or otherwise secured to the rearward face thereof.

OPERATION

In order that a better understanding of the invention might be had, the mode of operation of each embodiment will be described together since the operation of both embodiments is identical.

Figure 2:
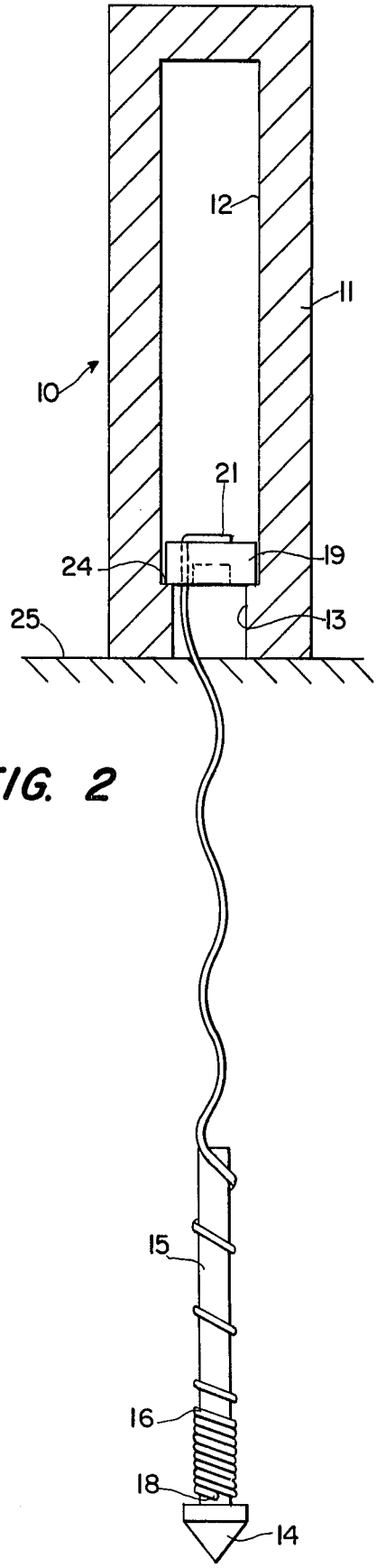
FIG. 2 illustrates the present invention after operation and shows the anchor body embedded in the surface to which the system is to be anchored.

The anchoring system 10 is first disposed against a surface 25, as seen in FIG. 2, to which the system is to be anchored. The surface 25 represents either dry land terrain or the sea bottom, depending upon what is being anchored. For example, the anchoring system might be fixed to a military radio (not shown) such as a jamming radio, which employs a tall whip antenna, to hold the radio in position and prevent wind from blowing the radio over. Alternatively, the system 10 might be fixed to the end of a line or cable if it were desired to anchor something in or under the water. Once the system 10 is in position the charge 22 is initiated. THe gas generated by ignition of the charge 22 drives the pusher plate 19 or 19' down the bore 12 until it engages a shoulder 24, defined by the intersection of the bore 12 and the socket 13, thus driving the anchor body 14 or 14' into the surface 25. The anchor body continues penetration of the surface 25 after the pusher plate has stopped until all the momentum of the anchor body is dissipated. This additional motion of the anchor body causes some of the anchoring wire 16 or 16' to unwind from about the shaft 15 or within the hollow shaft 15' as shown in FIG. 2. When the anchor body comes to rest the charge housing 11, and anything attached to it, will be firmly anchored to the surface 25. If the device being anchored is a jamming radio such as previously suggested, the embedded anchor provides an excellent electrical ground.

From the foregoing it will be evident that the anchoring system of the present invention possesses numerous advantages not available with prior art devices. For example, anchoring can be done remotely in any environment and on substantially any surface. If the characteristics of the surfaces to which anchoring is to be accomplished are known, the depth of penetration could be controlled by changing the mass of the anchor body, the diameter of the pusher plate, or the diameter and material of the anchor wire. Thus, any desired resistance to withdrawal could be obtained.

Obviously many modifications and variations of the present invention are possible in the light of the above teachings and would readily occur to those skilled in the art. It is therefore to be understood that within the scope of the appended claims the invention may be practiced otherwise than as specifically described.

What is claimed is:

1. An anchoring system for embedding an anchoring wire in a surface which may be remotely controlled and which may be employed in any environment comprising:

a charge housing having a central bore therein, one end of which communicates with the exterior of said housing;

a pointed anchor body disposed within said bore, said anchor body being hollow and having inner and outer ends;

a pusher plate abutting the inner end of said anchor body;

a coiled wire disposed within said anchor body, said wire directly attaching said anchor body to said pusher plate;

an explosive charge disposed within said bore behind said pusher plate for driving said pusher plate down the bore to eject said anchor body when said explosive charge is initiated; and means formed at the open end of said bore for stopping movement of said pusher plate while said anchor body continues on to embed itself under its own momentum whereby said coiled wire will unwind and said charge housing will be firmly anchored.

2. An anchoring system for embedding an anchoring wire in a surface which may be remotely controlled and which may be employed in any environment comprising:

a charge housing having a central bore therein, one end of which communicates with the exterior of said housing;

a pointed anchor body disposed within said bore, said anchor body having inner and outer ends, a substantial portion of the inner end of said anchor body being an elongated solid shaft;

a pusher plate abutting the inner end of said anchor body ;

a wire coiled about the surface of said shaft, said wire directly attaching said anchor body to said pusher plate;

an explosive charge disposed within said bore behind said pusher plate for driving said pusher plate down the bore to eject said anchor body when said explosive charge is initiated; and means formed at the open end of said bore for stopping movement of said pusher plate while said anchor body continues on to embed itself under its own momentum whereby said coiled wire will unwind and said charge housing will be firmly anchored.

3. The system of claims 1 or 2 wherein said movement stopping means comprises a section of said bore of a diameter less than the diameter of said pusher plate defining a shoulder which engages said pusher plate and precludes its exit from said bore.

* * * * *